United States Patent [19]

Stritzke

[11] Patent Number: 4,462,200

[45] Date of Patent: Jul. 31, 1984

[54] METHOD AND DEVICE FOR THE REMOVAL OF THE SUCTION TUBE OF A GLASS-FILLED FINAL STORAGE CONTAINER

[75] Inventor: Detlef Stritzke, Mol, Belgium

[73] Assignee: Deutsche Gesellschaft fur Wiederaufarbeitung, Fed. Rep. of Germany

[21] Appl. No.: 272,306

[22] Filed: Jun. 10, 1981

[30] Foreign Application Priority Data

Jun. 14, 1980 [DE] Fed. Rep. of Germany ..... 3022387

[51] Int. Cl.[3] ..... B65B 1/04; B65B 3/00

[52] U.S. Cl. ..... 53/467; 53/268; 53/477; 65/124; 141/113; 141/374; 215/32

[58] Field of Search ..... 53/122, 127, 268, 275, 53/281, 471, 440, 467, 472, 474, 477, 478; 141/113, 260, 312, 374; 215/30, 32; 65/124, 165, 210

[56] References Cited

U.S. PATENT DOCUMENTS 4,341,547 7/1982 Heimerl ..... 65/124 X

*Primary Examiner*—A. J. Heinz

*Attorney, Agent, or Firm*—Allegretti, Newitt, Witcoff & McAndrews, Ltd.

[57] ABSTRACT

A device for disposing of a contaminated suction tube connected to a storage container for glass-enclosed radioactive waste material by inserting the tube in the container for ultimate disposal with the container. The device consists of a metal sleeve that is mounted on the bottom wall of the container and extends upwardly into the container and an inner tube which slides in the sleeve. The suction tube is connected to the lower end of the inner tube. Detachable connecting means, such as solder, fixes the inner tube and hence the suction tube to the sleeve until the glass filling operation is over. At this point the solder melts and the suction tube and inner tube are free to be inserted into the container by sliding the inner tube upwardly in the sleeve.

16 Claims, 3 Drawing Figures

METHOD AND DEVICE FOR THE REMOVAL OF THE SUCTION TUBE OF A GLASS-FILLED FINAL STORAGE CONTAINER

The invention concerns a method and device for the removal and disposal of the suction tube of a glass-filled final storage container. Such containers are used to dispose of radioactive waste, and are filled with molten glass through the suction tube to encapsulate the waste. The suction tubes are contaminated and must be properly disposed of.

BACKGROUND OF THE INVENTION

In the PAMELA method, highly radioactive fission products from the reprocessing of burned-out fuel elements are fused into boron silicate glass. The final product is a glass that is bottled in a cylindrical final storage container, also called an "ingot mold", made of stainless steel.

In a method proposed in U.S. Pat. No. 4,341,547, for the withdrawal of glass from a ceramic melting furnace using the suction method, one needs a suction tube about 1 m long that penetrates into the glass melt. This suction tube must be connected vacuum-tight to the final or ultimate storage container until the completion of the filling process. Before disposing of the filled final storage container, the suction tube must be removed, since the container is then sealed. For the removal of the suction tube there are basically only two possibilities:

1. The suction tube is separated mechanically from the final storage container after the latter is filled. The tube still partially filled with radioactive glass is treated as a secondary waste product, and disposed of separately from the storage container.

2. The whole suction tube is pushed into the final storage container filled with still-molten glass, after completion of the filling.

THE INVENTION

The present invention provides a method and a device whereby in a simple and safe manner the removal of the suction tube is possible without producing any additional radioactive waste products. The method involves pushing the tube into the container so that it is disposed of with the container and its contents.

A number of advantages result from the construction of the invention. Since a mechanical separation from the container is done away with, no additional radioactive waste product results. The collecting of separated suction tubes in a separate container is dispensed with. Because of the fact that the suction tube is designed to be pushed into the container, extra handling devices for the separation of the suction tube and the corresponding operations can be dispensed with. After the insertion of the suction tube, the final storage container has the same form as without the tubes. The insertion of the suction tube can take place in the immediate vicinity of the outlet orifice of the melting furnace, which means that long transport distances for the final storage container with the glass clinging to the outside through the so-called "hot cell" are avoided.

THE DRAWINGS

The invention will now be explained in greater detail with the help of the attached drawings, in which examples of various embodiments are represented.

In the figures, like components are provided with like reference numbers for the sake of simplicity.

DETAILED DESCRIPTION

Figure 1:
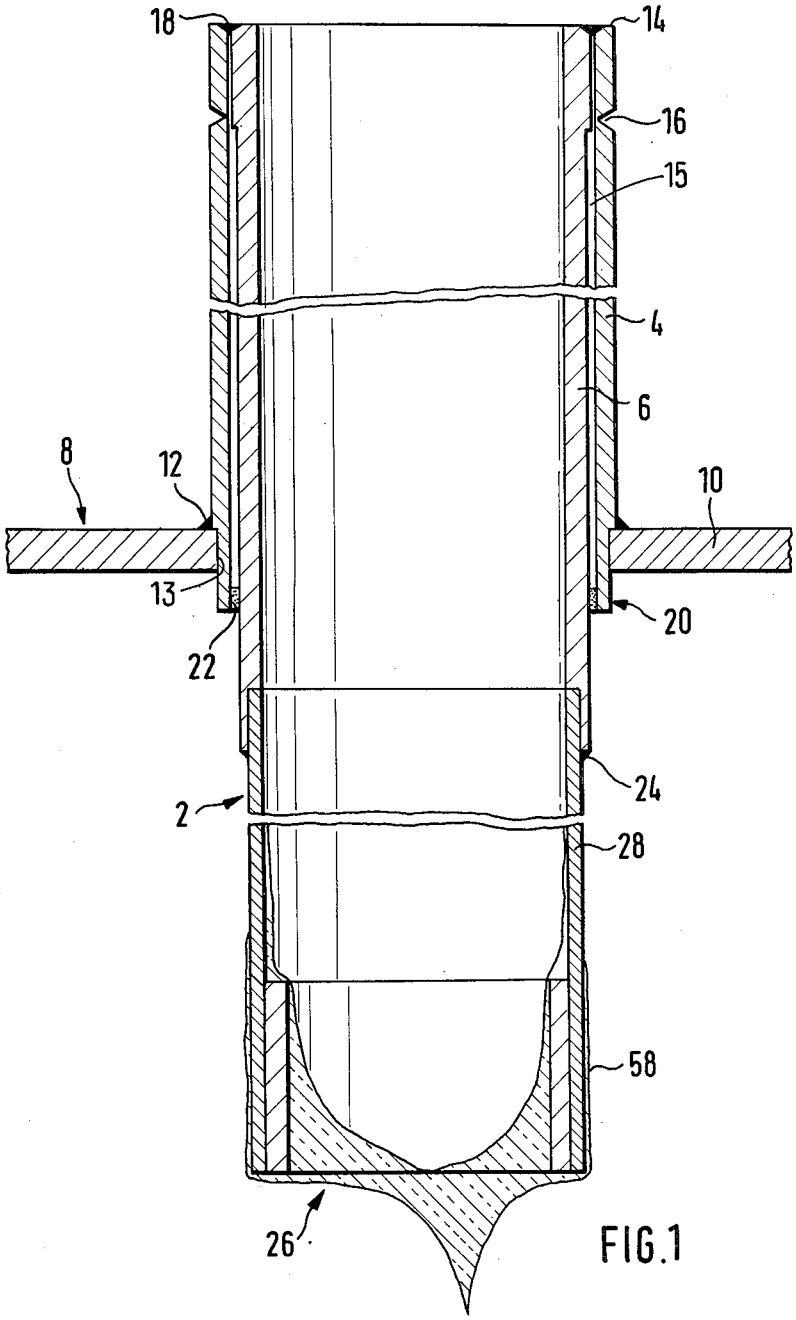
FIG. 1 shows in cross section a first embodiment of the invention for the removal of suction tubes.

FIG. 1 shows a suction tube 2 made of stainless steel #304 (German Spec. DIN 1.4301) that may be inserted into a final storage container 8 with the help of a cylindrical guide tube or sleeve 4, which projects upwardly into the container. A concentric tube 6 is slidably mounted inside the sleeve. Tube 6 is made of normal steel, ST 37, and is of lesser diameter than sleeve 4 to provide an annular space 15. A circumferential rib 7 on tube 6 maintains the space.

The sleeve 4 preferably is made of standard steel (St 37) and is mounted in an opening 13 in the base 10 and is welded solidly to the base at 12. A circumferential notch 16 is cut about 10 mm below the upper end 14 of the sleeve 4. The wall thickness of the sleeve at the bottom of the notch is about 0.1 mm. The weakness resulting from the circumferential notch permits breaking the inner tube 6 from the sleeve at a later time. The inner tube 6 is welded solidly at 18 to the guide sleeve 4 at the upper end 14. In order to protect the sleeve and tube from premature separation during handling, the guide sleeve 4 may be soldered at its lower end 20 to the inner tube 6 with a low-melting solder. The soldering at the lower end 20 of the fitting 4, 6 can be dispensed with if instead the notch 16 around the guide sleeve 4 is partially filled with a low-melting zinc- and cadmium-free solder. In either way adequate mechanical stability at the breaking notch 16 can be achieved in the cold state.

Figure 3:
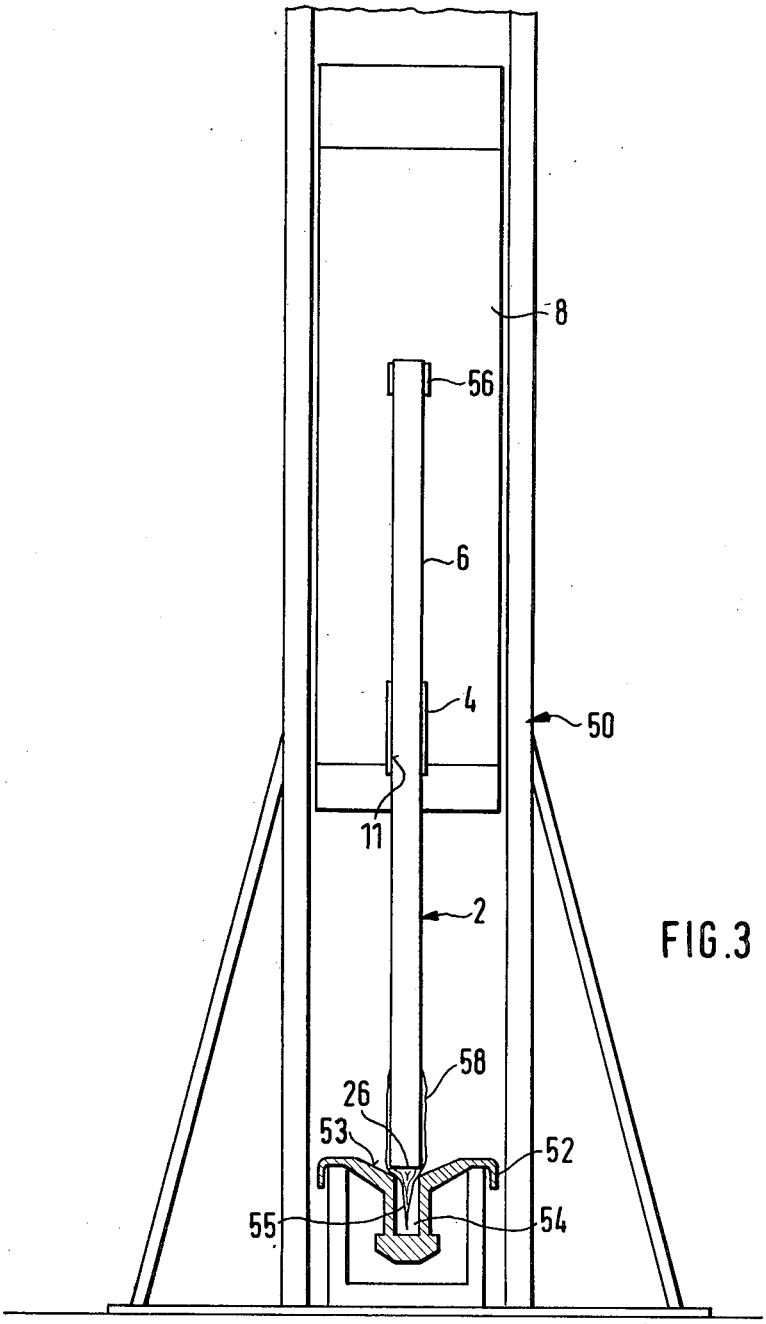
FIG. 3 shows schematically a final storage container made according to the invention in a guiding device.

The suction tube 2 is welded into the inner tube 6, at 24. The thus-prepared container bottom 10 with the incorporated fitting 4, 6 is then welded vacuum-tight into the container (FIG. 3). After the closing of the mouth or lower end 26 of the suction tube for evacuation, the final storage container is ready to be used for the withdrawal of glass from a melting furnace as shown in detail in copending application Ser. No. 165,214.

When the suction tube 2 is dipped into molten glass at 1200° C., the glass rises through the tube into the storage container 8. The heat from the glass melts the solder 22 at the lower end 20 or in the circular notch 16 and the whole fitting 4, 6 is heated to approximately the temperature of the glass melt. This frees the inner tube 6 and the connected suction tube 2 from the sleeve except for the weak connection at notch 16.

When the filling operation is completed, the storage container is raised about 20 cm above the furnace, so that the glass in the suction tube root 28 can congeal while the mouth 26 of the suction tube is still underneath the surface of the molten glass. This prevents flow of glass out of the final storage container after the suction tube 2 is pulled out of the melt. Then the suction tube is pushed upwardly to separate the inner tube 6 from the guide sleeve 4 at the notch 16 and move the tube 2 completely inside the container 8. The opening 11 in the bottom is closed, as is described in more detail below, in connection with FIG. 3.

Figure 2:
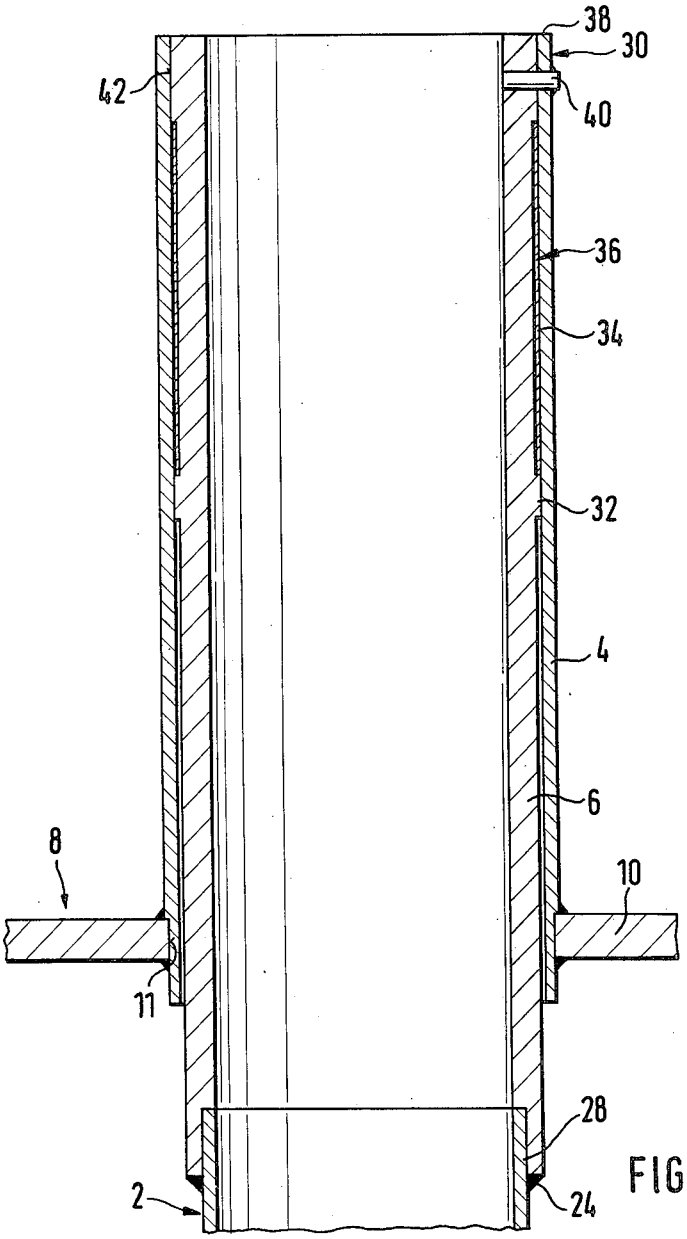
FIG. 2 shows another embodiment of the invention for the removal of suction tubes.

FIG. 2, to which reference is now made, shows another embodiment of the invention for the removal of the suction tube and for the production of a vacuum-tight connection between the guide sleeve 4 and the inner tube 6. The connection produced by this device also can be broken by slight exertion of force when the temperature at the connection is about 1200° C.

The assembly is basically the same as the one in the embodiment of FIG. 1. Between inner tube 6 and guide sleeve 4 there is a pair of annular rings on tube 6, one at the upper end 30 and the other 32 in the middle of the sleeve 4. Although the fit is close there is still enough play for the two tubes to be easily inserted into each other in the cold state.

The space 34 between the rings is about ≦0.5 mm wide. This space 34 is soldered preferably with a zinc- and cadmium-free special solder by the insertion of a shaped piece of solder in the space. A zinc- and cadmium-free solder is used because zinc and cadmium at the fluid gas temperature have a noticeable vapor pressure. About 5 mm from the upper edge 38 of the guide sleeve there is a security pin 40 whose diameter is about ≦1.5 mm and which consists of soft iron or another material with shear strength that decreases sharply with increasing temperature. The pin extends through aligned openings in the walls of the sleeve 4 and tube 6. The purpose of this pin is to prevent the suction tube 2 from being drawn into the storage container 8 by the suction and by the flowing glass after the solder is melted during the filling operation. As soon as the liquid glass rises in the suction tube 2, it melts the solder in the space 34. The solder serves as a sealing means between the low pressure in the final storage container and the atmospheric pressure and is confined between the annular rings. When the container 8 is filled with glass and fission products its weight shears the weakened pin and permits pushing the tube wholly within the container.

FIG. 3 shows how the final storage container 8, with the help of a guidance device 50, which prevents the tipping of the suction tube 2, is set down with the suction tube mouth 26 bearing on a support 52. This support also serves as the cover for the final storage container. The cover 52 has on its inner side 53 a slightly conical recess which provides a seat for the mouth 26 of the tube 2. The cover 52 is further provided with a well or hollow space 54 which serves as a container for any clinging glass threads or glass that comes loose from the end of tube 2.

After the solder joints are melted the weight of the glass-filled container 8 separates the guide sleeve 4 from the inner tube 6 at the cut-in notch 16 or at the shear pin 40. Only the upper part 56 of the guide sleeve 4 welded to the inner tube 6 stays on the tube.

The final storage container 8 and the guide sleeve 4 move downwardly as a unit to slowly disengage the inner tube 6 and the suction tube 2 as the latter is forced into the container. Because of the length of the guide tube 4, of the guideway 50, and the seating of the suction tube mouth 26 on the cover 52, tilting of the suction tube 2 during the insertion operation is not possible. Also, the suction tube 2 remains in place during the filling operation even with faulty handling.

The inside diameter of the guide sleeve is about 3.6 mm greater than the outside diameter of the suction tube 2. This provides an allowance for the increase in diameter of the suction tube due to the glass 58 adhering to the outside of it.

The force required for separating the inner tube 6 from the guide sleeve 4 at the cut-in notch 16 or the pin 40 is dependent on the temperature prevailing at this point. The notch or pin is therefore located, e.g. 9 cm into the final storage container, thereby preventing too rapid heat conduction via the metal to the base 10. The heat transfer through the glass itself takes place very slowly.

In order to separate the tube 6 from the sleeve 4, when St 37 steel (at 20° C.) is used, a force of 4800 N* is calculated for the cross sectional surface remaining after the notch is cut in. Experimentally, a force of 4600 N was obtained.

In the case of steels, it can be assumed that the tensile stress $\sigma$ at temperatures around 600° C. corresponds to about a fourth and at 900° C. to about a tenth of the tensile strength at 20° C. Experiments on pushing the suction tube 2 into the molten glass-filled final storage container showed that the force for separating the fitting 4, 6 at the temperature of the molten glass was $<1000$ N.

*N+1 Newton+0.225 lb/sec$^2$

By setting the final storage container 8 on the base 52, this force was achieved by the inherent weight of the glass-filled container 8.

It is to be understood that the embodiment of the invention which has been described is merely illustrative of one application of the principles of the invention. Numerous modifications may be made to the disclosed embodiment without departing from the true spirit and scope of the invention.

What is claimed is:

1. A method for disposing of a suction tube connected to a storage container for radioactive waste and encapsulating glass which comprises (a) providing a sleeve in the bottom of said container projecting up into said container with said suction tube slidably mounted therein and a heat-sensitive metal connector between said sleeve and said tube disposed above said bottom inside the container, (b) causing said connector to break by passing molten glass through said tube gradually to heat the connector to the point where it breaks under the weight of said container, (c) rigidly supporting the lower end of said tube so that the tube pushes up into said container as the container moves downwardly to the lower end of said tube, whereby the tube is completely enclosed within the container, and (d) sealing said container bottom in the area below said sleeve and tube.

2. The method of claim 1 in which said tube is cooled prior to step (c) to congeal molten glass in the lower end of the suction tube to prevent glass from flowing out of said container.

3. A device for disposing of a suction tube within a storage container for radioactive waste to which said tube is connected comprising (a) a guide sleeve mounted in the bottom wall of said container and extending upwardly into the interior of said container, (b) an inner tube slidably mounted within and spaced from said guide sleeve to which said suction tube is connected, (c) connector means disposed above said bottom wall within the container detachably connecting said inner tube to said sleeve, said connector means being detachable at elevated temperature thereby detaching the inner tube from the sleeve and permitting the suction tube to move relative to the sleeve and be pushed up into said container for disposal therewith.

4. The device of claim 3 in which said sleeve is welded to said inner tube at the top and said connector means comprises a circumferential notch in the wall of said sleeve disposed below said weld whereby under force the sleeve will break at the notch.

5. The device of claim 4 in which said notch contains solder which melts at the temperature of molten glass.

6. The device of claim 5 in which said solder is free of zinc and cadmium.

7. The device of claim 3 in which said connector means comprises a pin extending through aligned openings in said sleeve and inner tube, said pin being made from metal which greatly weakens at the temperature of molten glass.

8. The device of claim 7 which said connector means also includes solder disposed in the space between said inner tube and said sleeve just below said pin.

9. The device of claim 3 wherein said suction tube is welded to the end of said inner tube.

10. The device of claim 3 wherein said inner tube has a pair of annular rings in contact with the inner wall of said sleeve, the space between said rings being filled with solder.

11. The device of claim 3 which also includes a cover to enclose the opening in said bottom wall surrounding said sleeve when the inner tube and suction tube are pushed into said container.

12. The device of claim 11 in which said cover has a central conical recess for supporting the lower end of the suction tube when the tube is being pushed into the container.

13. The device of claim 11 in which said cover also includes a well to receive loose glass on the end of the suction tube.

14. The device of claim 11 which includes guidance means for supporting said storage container and suction tube and aligning them with said cover during insertion of said suction tube.

15. The device of claim 3 in which said connector means comprises solder disposed in the space between said inner tube and said sleeve.

16. The device of claim 3 in which the inside diameter of said guide sleeve is sufficiently greater than the outside of said suction tube to allow for the increase in diameter of said suction tube by reason of glass adhering to the outside of said suction tube.

* * * * *